United States Patent [19]

Hart

[11] Patent Number: 4,785,160

[45] Date of Patent: Nov. 15, 1988

[54] SLEEVE TYPE CARTON FOR MICROWAVE COOKING

[75] Inventor: Joseph J. Hart, Philadelphia, Pa.

[73] Assignee: Container Corporation of America, Clayton, Mo.

[21] Appl. No.: 81,706

[22] Filed: Aug. 4, 1987

[51] Int. Cl.[4] ..... H05B 6/80

[52] U.S. Cl. ..... 219/10.55 E; 219/10.55 F; 99/DIG. 14; 426/107; 426/113; 426/243; 229/128

[58] Field of Search ..... 219/10.55 E, 10.55 F, 219/10.55 R; 99/DIG. 14, 451; 229/120, 121, 122, 128, 131; 426/107, 113, 115, 234, 241, 243

[56] References Cited

U.S. PATENT DOCUMENTS

| | | | |
|---|---|---|---|
| 1,123,591 | 1/1915 | Raade | 229/128 X |
| 4,013,798 | 3/1977 | Goltsos | 426/107 |
| 4,130,237 | 12/1978 | Struble | 229/128 X |
| 4,190,757 | 2/1980 | Turpin et al. | 99/451 X |
| 4,228,945 | 10/1980 | Wysocki | 219/10.55 G X |
| 4,325,507 | 4/1982 | Janhonen | 229/122 X |
| 4,553,010 | 11/1985 | Bohrer et al. | 219/10.55 E |
| 4,592,914 | 6/1986 | Kuchenbecker | 219/10.55 G X |

*Primary Examiner*—Philip H. Leung
*Attorney, Agent, or Firm*—Richard W. Carpenter

[57] ABSTRACT

A disposable, sleeve type carton formed from foldable paperboard, coated with electrically conductive material to assist in browning a food item, and including top, bottom, and side wall panels interconnected to form a tubular structure, with end closure panels hinged to the bottom wall panel and having interlocking engagement with the top wall panel.

9 Claims, 3 Drawing Sheets

Fig. 1
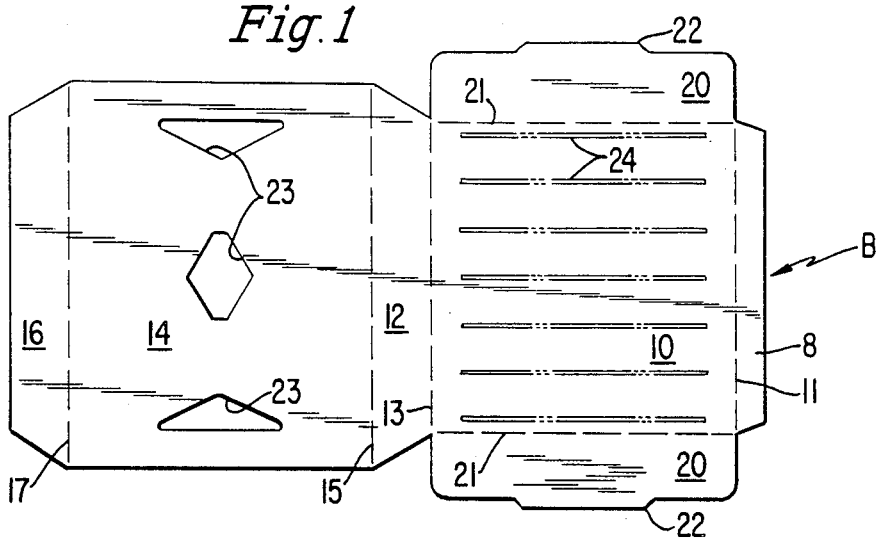
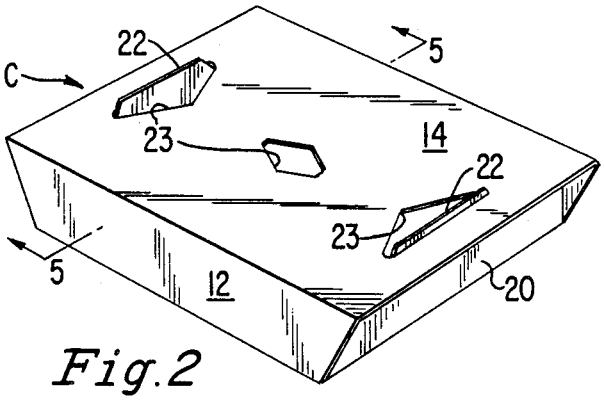
Fig. 2
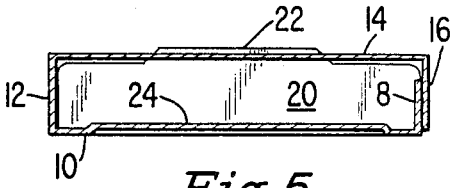
Fig. 5
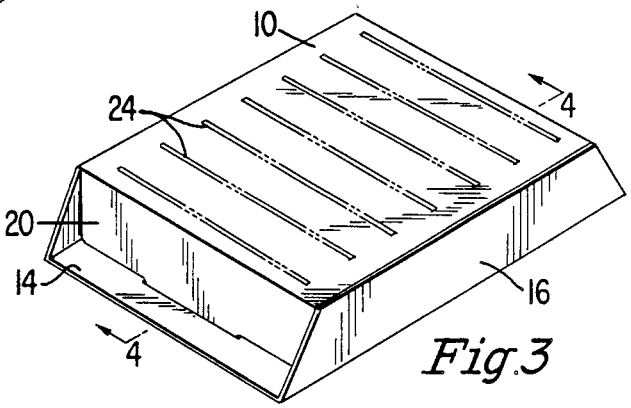
Fig. 3
Fig. 4
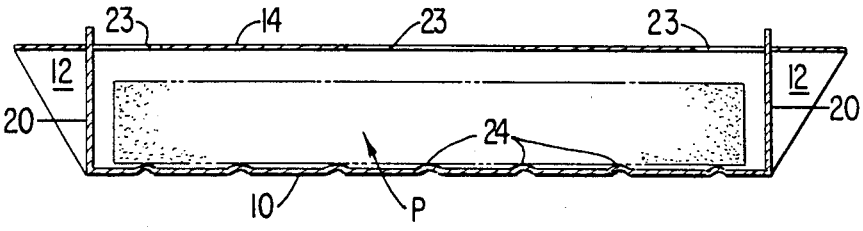

SLEEVE TYPE CARTON FOR MICROWAVE COOKING

BACKGROUND OF THE INVENTION

1. Field of the Invention:

This invention relates to food packaging, and primarily to a paperboard carton adapted for holding a food item and assisting in its browning in a microwave oven.

2. Description of Background Art:

A background art search directed to the subject matter of this application in the United States Patent and Trademark Office disclosed the following U.S. Pat. Nos.: 2,830,162, 3,701,872, 3,731,037, 3,854,623, 3,881,027, 3,924,013, 4,147,836, 4,190,757, 4,230,924, 4,266,108, 4,267,420, 4,283,427, 4,306,133, 4,337,116, 4,496,815, 4,518,651, 4,542,271, 4,555,605, 4,567,341, 4,590,349, 4,592,914, 4,612,431, 4,626,641, 4,641,005; and Canadian Pat. No. 1,153,069.

None of the patents uncovered in the search discloses a disposable, sleeve-type, paperboard carton, coated with electrically conductive matter to assist in browning a food item, and including top, bottom, and side wall panels interconnected to form a tubular structure, with end closure panels hinged to the bottom wall panel and having interlocking engagement with the top wall panel.

SUMMARY OF THE INVENTION

It is an object of the invention to provide a sleeve-type paperboard folding carton adapted to hold an article of food and to assist in browning the outer surface of the food when subjected to microwave radiation.

A more specific object of the invention is the provision of a sleeve-type carton which may be used as an inner package, with an overwrap or outer carton, either in one package or as one of a plurality of inner packages in a multipack arrangement.

Another specific object of the invention is a provision of a sleeve-type paperboard carton, of the type described, having end walls which include at least one panel having interlocking engagement with respect to the upper wall of the carton.

These and other objects of the invention will be apparent from an examination of the following description and drawings.

BRIEF DESCRIPTION OF THE DRAWINGS

FIG. 1 is a plan view of a blank of foldable sheet material from which a carton embodying features of the present invention can be formed;

FIG. 2 is a fragmentary isometric view of a carton formed from the blank illustrated it FIG. 1;

FIG. 3 is an inverted isometric view of the carton illustrated in FIG. 2;

FIG. 4 is a longitudinal, vertical, sectional view taken on line 4—4 of FIG. 3;

FIG. 5 is a transverse, vertical, sectional view taken on line 5—5 of FIG. 2;

Figure 6:
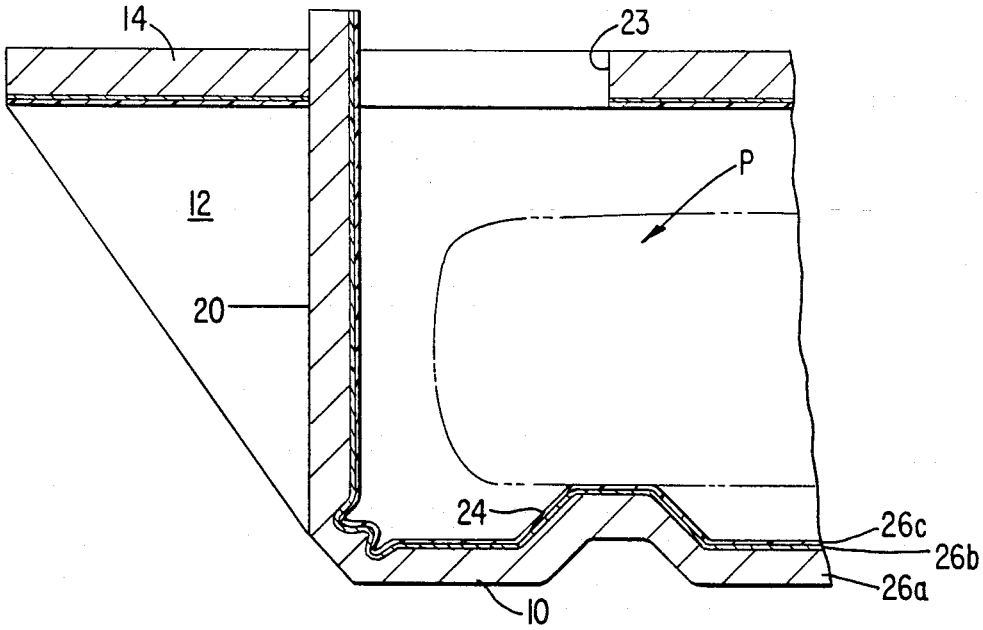
FIG. 6 is an enlarged view of a portion of the structure illustrated in FIG. 4.

It will be understood that, for purposes of clarity, certain elements may have been intentionally omitted from certain views where they are believed to be illustrated to better advantage is other views.

DESCRIPTION OF THE PREFERRED EMBODIMENT

Referring now to the drawings for a better understanding of the invention, and particularly to FIGS. 1 through 6, it will be seen that there is provided a sleeve-type, collapsible, disposable, folding carton, indicated generally at C, which may be formed from a unitary blank B of foldable sheet material, such as paperboard, illustrated in FIG. 1 of the drawings.

As best seen in FIG. 1, the blank B from which the folding carton C may be formed includes a relatively narrow first side wall inner panel 8, a bottom wall panel 10, a second side wall panel 12, a top wall panel 14, and a first side wall outer panel 16, which panels are joined to each other along parallel fold lines 11, 13, 15, and 17, respectively. When the first side wall inner and outer panels 8 and 16, respectively, are secured to each other in overlapped relation, a tubular structure is formed which is open at the ends.

The open end of the carton are closed by end wall panels 20. Each of the end wall panels 20 is foldably joined along a fold line 21 to a related end edge of bottom wall panel 10. Each of the end wall panels has projecting from its free edge a lock tab 22, the purpose of which is described later in the specification.

Top wall panel 14 of the carton is provided with a plurality of openings 23 extending therethrough which are spaced from each other longitudinally of the carton top wall and which serve as vent openings. The end openings 23 also serve as openings for receiving the lock tabs 22 of the respective end wall panels 20, to provide interlocking engagement between the end wall panels and the top wall of the carton.

As best seen in FIGS. 1 and 4 and 5, the bottom wall 10 is embossed or debossed to provide a plurality of transversely spaced, laterally extending, parallel ribs 24 which project upwardly from the bottom wall and which are adapted to hold a product P, such as an item of food, above the upper surface of the bottom wall in spaced relation therewith.

As best seen in FIG. 6, which is an enlarged view of portions of the structure illustrated in FIG. 4, the carton is a laminate which consists of a layer **26*a* of paperboard on which is deposited a layer 26*b* of conductive material, such as metal, which in turn is coated with an outer protective layer 26*c*** of plastic film material. The purpose of the metal layer is to convert some of the microwave energy to radiation energy for browning the outer surface of an article of food within the carton in a microwave oven. Thus it will be appreciated that the carton provides a convenient inner pack, to be used with an outer wrapping or pack, not shown, either singly or in a multipack arrangement. The carton may be opened and closed easily for convenience in using it as an oven within an oven to heat and brown an item of food.

Figure 8:
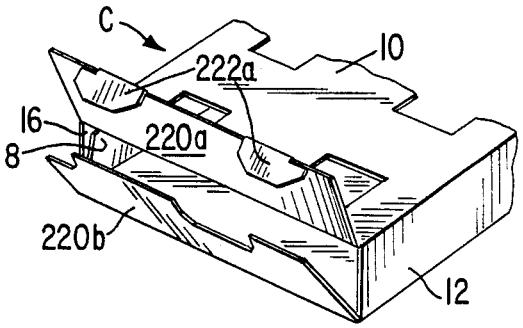
FIGS. 7–9 are fragmentary views similar to that of FIG. 2, but illustrating alternate embodiments of the invention with different types of end closure arrangements.
Figure 7:
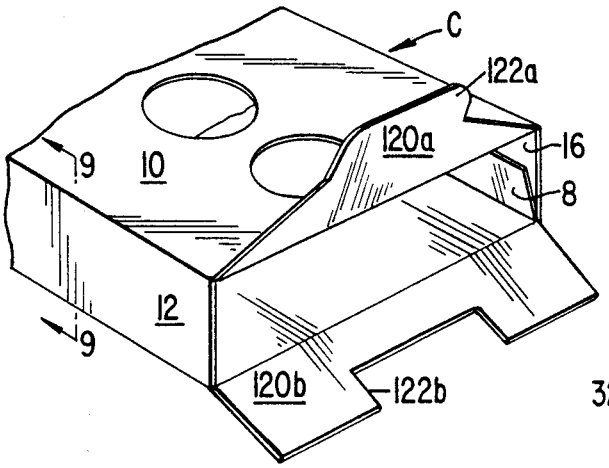
Figure 9:
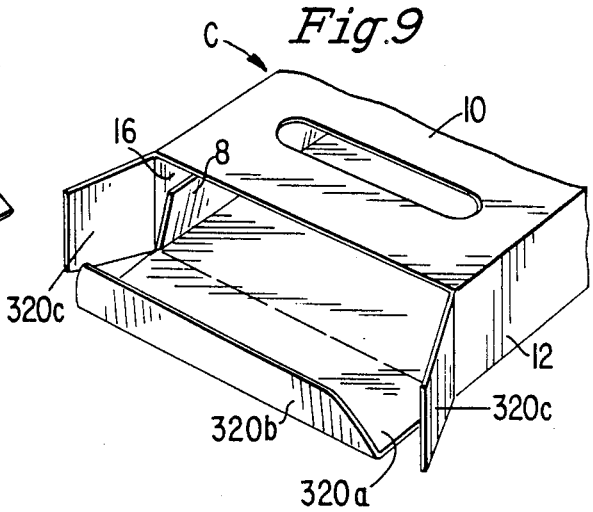

Referring now to FIGS. 7, 8, and 9, it will be seen that slightly modified forms of the invention are shown. In each view portions of the structure which correspond to portions of the structure previously described have been identified with similar numerals. The package illustrated in each of these views is similar to the previously described embodiment except for the various end closure arrangements illustrated.

In FIG. 7, the end wall consists of a pair of closure panels 120a and 120b, which are foldably joined to the end edges of top and bottom walls 14 and 10 and which are disposed to be folded into partially overlapped relation, with a tongue or lock tab 122a of panel 120a being disposed for interlocking engagement within an opening 122b of panel 120b.

In FIG. 8, a slightly different end closure arrangement is provided. In this arrangement one of the closure panels 220a is provided with a pair of lock tabs or tongues 222a which are adapted to be inserted within openings, not shown, which are located between the other end panel 220b and the bottom wall of the carton to provide interlocking engagement, with panels 220a and 220b disposed in overlapping relationship.

Now turning to FIG. 9, it will be seen that a slightly different end closure arrangement is provided. In this arrangement an end closure panel 320a has an integral lock tab 320b foldably joined to its outer edge and adapted to be inserted within the carton under the top wall panel 14. There may also be provided dust flaps or charlottes 320c hingedly joined to opposite end edges of the side walls and adapted to be folded in under the end wall panel 320a when the carton is closed.

Figure 11:
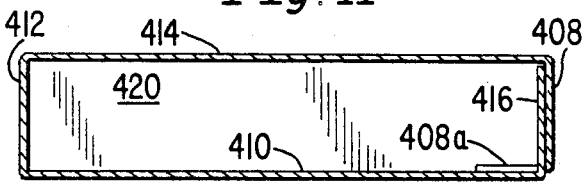
FIGS. 10 and 11 are views similiar to those of FIGS. 1 and 5, respectively, but illustrate a modified form of the invention.
Figure 10:
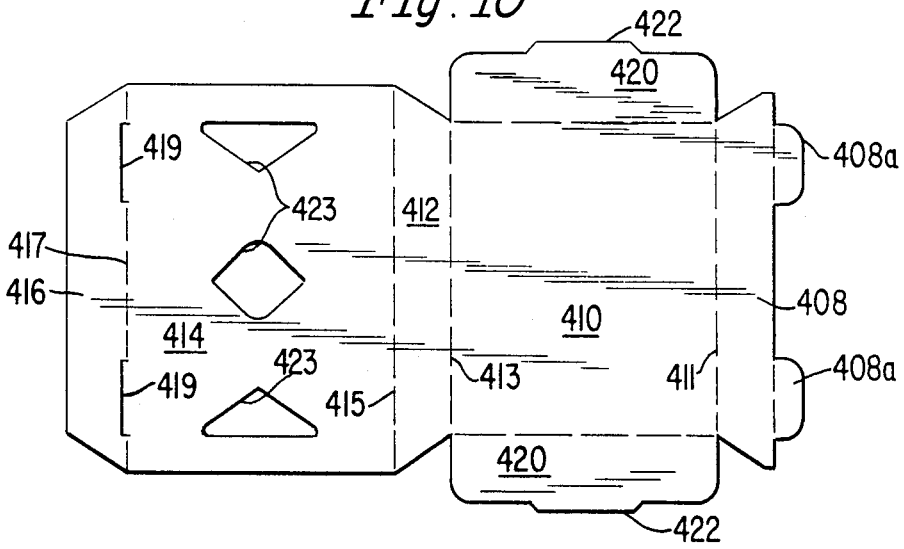

Turning now to FIGS. 10 and 11, it will be seen that another slightly modified form of the invention is shown. In this form, one of the side wall panels 408 is provide with a pair of integral lock tabs 408a adapted to be inserted within slits or openings 419 located at the opposite side of the carton blank in alignment with the hinge line 417 which joins the outer side wall panel 416 to the top wall panel 414.

Figure 12:
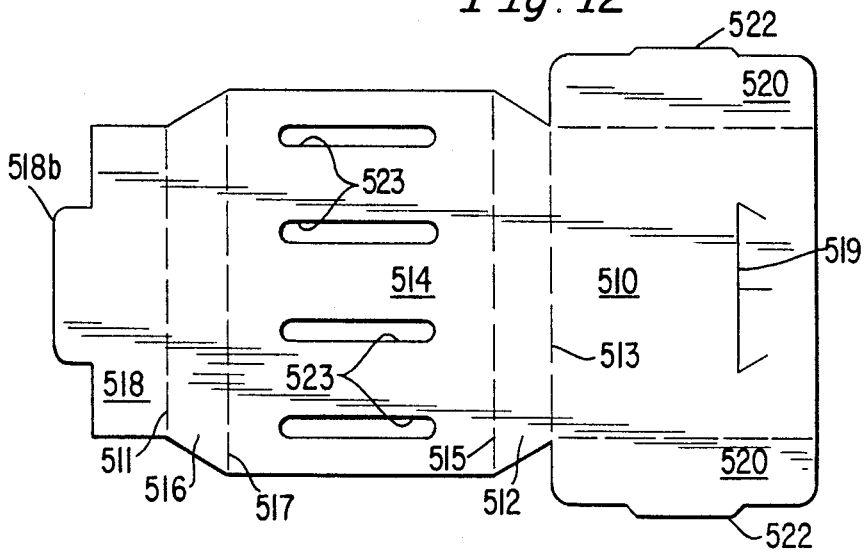
FIGS. 12, 13 and 14 are views similiar to those of FIGS. 1, 5, and 2, respectively, but illustrate yet another form of the invention.
Figure 13:
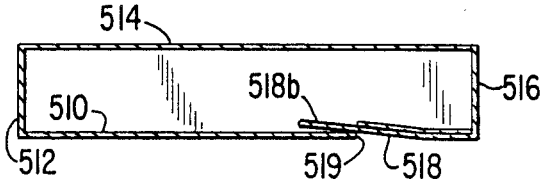
Figure 14:
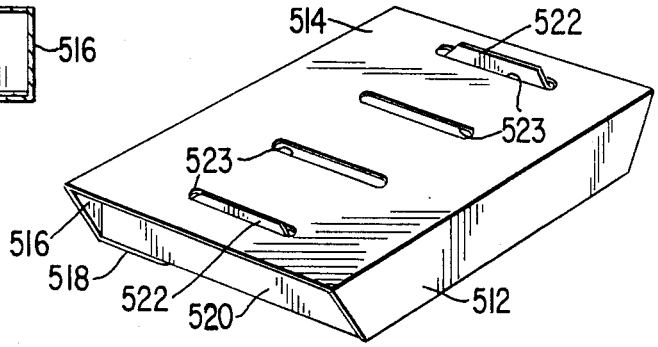

Now turning to FIGS. 12–14, it will be seen that yet another form of the invention is shown. In this embodiment side wall panel 518 is provided with an integral tongue or projection 518b which is adapted to be inserted within a slit 519 formed within bottom wall 510 of the carton.

It will be appreciated that each of the embodiments previously described has the common feature of being a sleeve-type carton with a convenient end closure arrangement adapted to hold items of food and assist in browning in a microwave oven.

In each case the carton is an inner pack to be used with an outer pack, either in a single package or with a plurality of similar packages in a multipack arrangement.

What is claimed is:

1. A disposable, sleeve-type carton adapted to hold an item of food and assist in browning the exterior thereof when subjected to microwave radiation, said carton being formed from a unitary blank of foldable paperboard coated on at least one surface with a layer of an electrically conductive material, and comprising:

(a) top and bottom major walls foldably joined to each other by a pair of opposed minor walls to form a tubular structure open at the ends;

(b) one of said major walls being longer than the other of said major walls and having, inboardly adjacent opposite ends thereof, openings extending therethrough;

(c) a pair of opposed end walls for closing opposed ends of said tubular structure, each of said end walls including at least one end wall panel foldably joined to an end edge of the other of said major walls and including a lock tab projecting therefrom and adapted to be received within a related opening in said one major wall to provide interlocking engagement between said end walls and said one major wall;

(d) said bottom major wall being embossed to present a plurality of spaced parallel ribs projecting upwardly therefrom for direct contact with said food item to support said food item a slight distance above an upper surface of said bottom major wall.

2. A disposable, sleeve-type carton adapted to hold an item of food and assist in browning the exterior thereof when subjected to microwave radiation, said carton being formed from a unitary blank of foldable paperboard coated on at least one surface with a layer of an electrically conductive material, and comprising:

(a) top and bottom major walls foldably joined to each other by a pair of opposed minor walls to form a tubular structure open at the ends;

(b) at least one of said walls having at least one vent opening extending therethrough;

(c) a pair of opposed end walls for closing opposed ends of said tubular structure, each of said end walls including at least one end wall panel foldably joined to an end edge of a major wall and extending toward the other major wall and including a lock tab projecting therefrom adapted to provide interlocking engagement with respect to the other of said major walls;

(d) said bottom major wall being embossed to present a plurality of spaced parallel ribs projecting upwardly therefrom for direct contact with said food item to support said food item a slight distance above an upper surface of said bottom major wall.

3. A carton according to claim 2, wherein said ribs extend transversely of said bottom wall.

4. A carton according to claim 2, wherein said vent openings are spaced from each other longitudinally of said top wall.

5. A carton according to claim 2, wherein each of said end wall panels includes an integral lock tab projecting therefrom for interlocking engagement within a vent opening of said top wall.

6. A carton according to claim 2, wherein said one end wall panel includes an integral tab adapted to be inserted into the carton under a marginal portion of the other of said major walls.

7. A carton according to claim 2, wherein each of said end walls includes a pair of end wall panels foldably joined to end edges of respective major walls and adapted to be folded into overlapping relation with each other.

8. A carton according to claim 7, wherein one of said end wall panels includes an integral tuck tab adapted to be received within an opening adjacent a fold line joining the other of said end panels to a related major wall.

9. A carton according to claim 7, wherein said end wall panels are adapted for interlocking engagement with each other.

* * * * *